United States Patent [19]

Langen et al.

[11] Patent Number: 4,805,375

[45] Date of Patent: Feb. 21, 1989

[54] CARTON END CLOSURE

[75] Inventors: Marinus J. M. Langen, Toronto; Peter Guttinger, Milton, both of Canada

[73] Assignee: H. J. Langen & Sons Limited, Mississauga, Canada

[21] Appl. No.: 133,606

[22] Filed: Dec. 16, 1987

[51] Int. Cl.[4] ..... B65B 7/22

[52] U.S. Cl. ..... 53/142; 53/374; 53/381 R

[58] Field of Search ..... 53/142, 252, 282, 284, 53/374, 375, 381 R, 566

[56] References Cited

U.S. PATENT DOCUMENTS

| | | | |
|---|---|---|---|
| 4,251,978 | 2/1981 | Beck | 53/374 X |
| 4,509,309 | 4/1985 | Langen et al. | 53/142 |
| 4,759,167 | 7/1988 | Langen et al. | 53/142 |

*Primary Examiner*—John Sipos
*Assistant Examiner*—Beth Tenney

[57] ABSTRACT

A carton loading machine for loading cartons which have first and second side closure flaps each comprising a proximal panel and a distal panel. The machine includes a tucking mechanism which serves to fold the distal panels into a face-to-face relationship with their associated proximal panels and thereafter, if folds the proximal panels inwardly along their hinge connection with the side walls of the carton while setting the distal panels at an oblique angle with respect to the side walls of the carton.

13 Claims, 6 Drawing Sheets

CARTON END CLOSURE

This invention relates to carton loading machines. In particular, this invention relates to a tucking and folding mechanism for closing the end of a loaded carton.

Because of the complex manipulation required in order to close the end of a carton of the type which has end flaps which form stiffening columns which cooperate with the load item to rigidify the carton, difficulty was experienced in designing a mechanism which would permit this operation to be carried out at high speed.

It is an object of the present invention to provide a carton closure mechanism which is capable of operating continuously at high speed while carrying out complex tucking and folding operations on the end closure flaps of a carton.

According to one aspect of the present invention, there is provided in a carton loading machine in which loaded cartons are conveyed through an end closure station, each carton having a load storage compartment formed therein, first and second oppositely disposed side closure flaps hingedly connected to the opposite side walls of the carton along side hinges, said first and second side flaps each comprising a proximal panel which extends from its associated side hinge and a distal panel which is hingedly connected to the proximal panel along a second hinge which extends parallel to the side hinge, the proximal panel having an extension which projects beyond the second hinge line and is initially co-extensive with the distal panel, the improvement of means for initially locating the proximal panels and their extensions so that they extend in the plane of their associated side wall and the distal panels extend transversely inwardly across the open end of the article storage compartment, tucking means for tucking and folding the side closure flaps, each tucking means comprising a set of right and left tucking arms each having a proximal end and a distal end, means pivotally mounting said right and left tucking arms in a side-by-side relationship with their distal ends directed toward the open end of a carton in use, each tucking arm having long and short fingers projecting one on either side of a notch formed at the distal end thereof, the long fingers of the tucking arms of each set being located adjacent one another, means for moving the tucking arms relative to their associated carton to initially advance the tucking arms of each set toward an open end of the associated carton to cause the long finger to engage the transversely extending distal panels and to fold the distal panels into a face-to-face relationship with their associated proximal panels and thereafter to cause the tucking arms of each set to pivot, to cause the distal ends thereof to toe-in toward one another to fold the proximal panel about its side hinge line and release the distal panel to allow it to pivot away from the proximal panel along said second hinge line to be located within the carton in a position extending obliquely toward its associated side wall, and thereafter to withdraw the tucking arms and progressively return the tucking arms to their initial position.

According to a further aspect of the present invention there is provided in a carton loading machine are conveyed through an end closure station on a primary conveyor, each carton having a load storage compartment formed therein, first and second oppositely disposed side closure flaps hingedly connected to the opposite side walls of the carton along side hinges, said first and second side flaps each comprising a proximal panel which extends from its associated side hinge and a distal panel which is hingedly connected to the proximal panel along a second hinge which extends parallel to the side hinge, the proximal panel having an extension which projects beyond the second hinge line and is initially co-extensive with the distal panel, said first and second side flaps each having a passageway opening therethrough which extends on opposite sides of said second hinge line so as to form a clearance notch extending from each second hinge line when the flaps are folded along said second hinge lines, the improvement of means for initially locating the proximal panels and their extensions so that they extend in the plane of their associated side wall and the distal panels extend transversely inwardly across the open end of the article storage compartment, tucking means for tucking and folding the side closure flaps, each tucking means comprising a set of right and left tucking arms each having a proximal end and a distal end, means pivotally mounting said right and left tucking arms in a side-by-side relationship with their distal ends directed toward the open end of a carton in use, each tucking arm having long and short fingers projecting one on either side of a notch formed at the distal end thereof, the long fingers of the tucking arms of each set being located adjacent one another, a first folding blade, a second folding blade and a tucking cam mounted for simultaneous movement in a first direction and a second direction away from an open end of a carton during movement through said end closure station, said first folding blade being out of alignment with said clearance notch so as to contact the distal panels to fold them along the second fold line during movement in said first direction, said first folding blade being proportioned to pass between said proximal panels when they are folded inwardly toward one another, said second folding blade having a distal end directed toward an open end of a carton in use, said distal end being formed with a pair of notches which extend inwardly thereof and are arranged to be aligned with the side walls of a carton during movement in said first direction, said second folding blade having a folding portion forming an inner wall of said notch, said folding portion being aligned with and proportioned to fit within the clearance notch of the side flaps as the side flaps are folded along the first fold line, said tucking cam having a cam face extending transversely of the path of travel of the slide member as it moves in said first direction, said tucking cam having a concave arc of curvature which is arranged to bear against the second hinge lines to tuck the distal panels rearwardly of the proximal panels, means for moving the tucking means to and fro in said first and second directions during movement through end closure station.

According to yet another aspect of the present invention, there is provided in a carton in a carton having a load storage compartment formed therein, the improvement of first and second oppositely disposed side closure flaps hingedly connected to the opposite side walls of the carton along a first hinge, said first and second side flaps each comprising a proximal panel which extends from its associated first hinge and a distal panel which is hingedly connected to the proximal panel along a second hinge which extends parallel to the first hinge, the proximal panel having an extension which projects beyond the second hinge and is initially co-extensive with the distal panel, a through passage formed in each side closure flap which extends across the first hinge to provide an access notch in each proximal panel and its associated distal panel, said notches serving to provide clearance for a tucking blade to extend therethrough to tuck the distal panel in behind the proximal panel in use.

The invention will be more clearly understood after reference with the following detailed specification read in conjunction with the drawings wherein;

FIG. 1 is a pictorial view of a carton of the type which is to be closed by the mechanism of the present invention, FIG. 2 is a pictorial view illustrating a tucking and folding mechanism constructed in accordance with an embodiment of the present invention, FIG. 3 is a plan view of a portion of the mechanism of FIG. 1 illustrating six positions of the tucking mechanism in relation to the carton which is to be closed, FIG. 4 is a section view taken along the line 4—4 of FIG. 3, FIG. 5 is a section view taken along the line 5—5 of FIG. 3.

Figure 1:
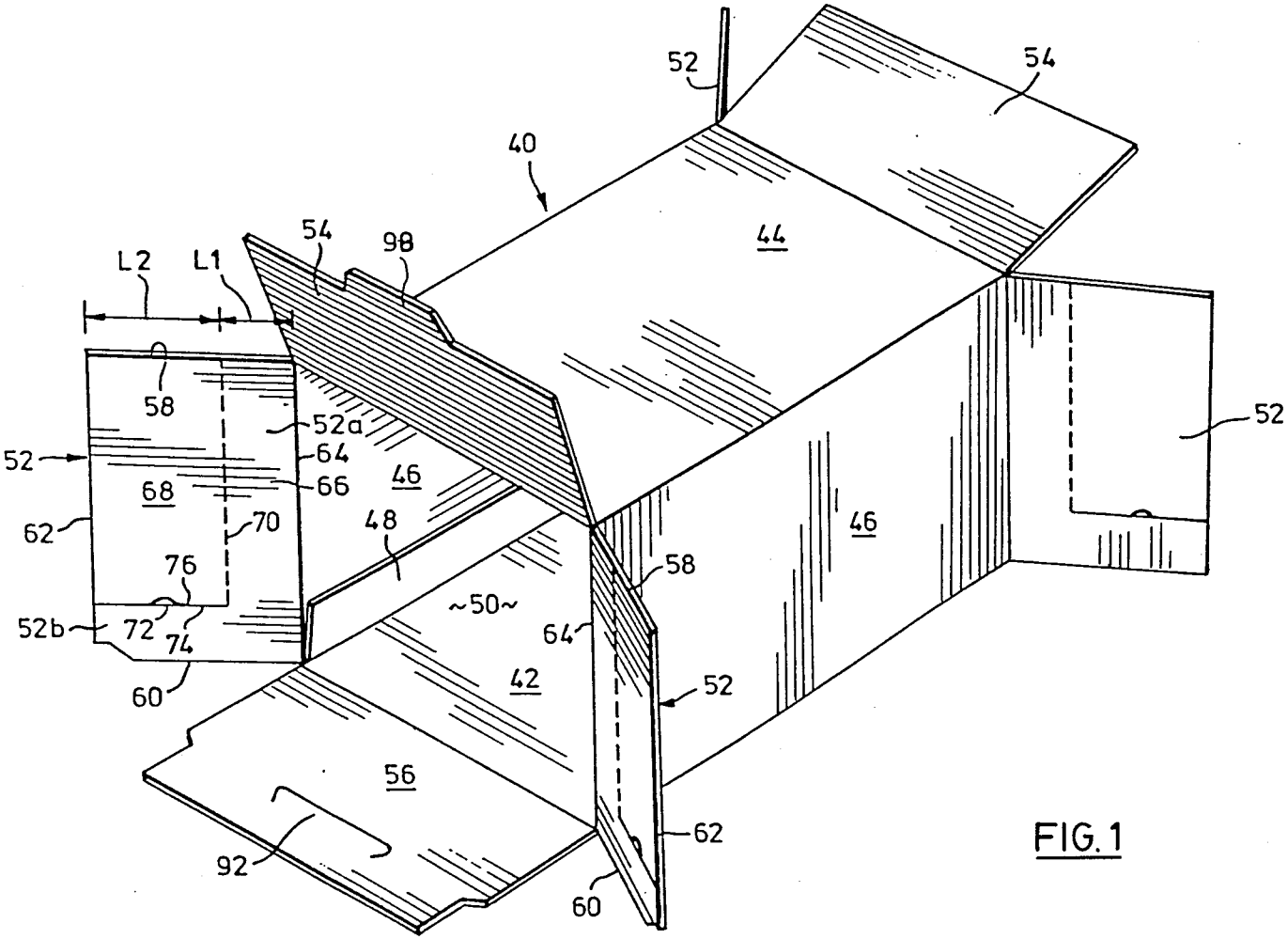

A carton of the type which is to be closed by the machine of the present invention is illustrated in FIG. 1 of the drawings and is generally identified by the reference numeral 40. The carton 40 has a bottom wall 42, a top wall 44, a pair of oppositely disposed side walls 46 and a longitudinally extending tab 48 which is formed integrally with the bottom wall 42 and is adhesively secured to one of the side walls 46. When the carton 40 is in the open configuration shown in FIG. 1, the bottom, top and side walls cooperate to provide an open storage compartment 50. A pair of side flaps 52, a top flap 54 and a bottom flap 56 are hingedly connected to each end of the bottom wall 42, top wall 44 and side walls 46 respectively. Each side flap 52 has an upper edge 48, a lower edge 60 and an outer edge 62 and is hingedly connected along a side hinge 64 to the side wall 46. Each side flap 52 is formed with a generally L-shaped proximal panel 66 and a rectangular-shaped retainer or distal panel 68. The proximal panel 66 is connected to the distal panel 68 along a second hinge line 70 and is separated from the first panel 66 along the cut line 72. Each L-shaped proximal panel 66 has an extension portion **52*b* which projects from an inner portion 52*a* and is initially co-extensive with the distal panel 68. The proximal panel 66 and the distal panels 68 have oppositely disposed side edges 74 and 76 on opposite sides of the cut line 72**.

In use, a sealed beam headlight unit 32 is located in the storage compartment 50 with the front face 36 thereof facing the bottom wall 42. The compartment 50 is proportioned to ensure that when the sealed beam unit is located in the container space, its electrical terminals will be spaced from the top wall 44. Lugs which project laterally from the body portion of the sealed beam unit and form shoulders which are oppositely disposed with respect to the front face of the lens. The body of the sealing beam unit which extends between the shoulder and the front face is strong and rigid. The shoulders normally bear against the mounting frame in which the sealed beam unit is supported for alignment.

The lower side edge 76 of the retainer or distal panel 68 is arranged to bear against the shoulder of the lens and the upper side edge 58 is arranged to bear against the top wall 44 such that the retainer panel 68 acts as a spacer serving to maintain the top wall in a spaced relationship with respect to the shoulders of the lens and in so doing, is effective in maintaining a spaced relationship between the top wall 40 and the electrical terminals 38.

The length L2 of the retainer panel 68 is longer than the length L1 such that when the retainer panel 68 is folded inwardly to overlie the shoulders of the lens, it will assume the position wherein the outer edge 62 will contact a side wall 46. Preferably, the dimensions L1 and L2 are selected so that the angle 0 is of the order of about 45°. The retainer panel 68 and the length L1 of the flap 52 will cooperate with of the side wall 46 to form a hollow triangular-shaped column. The lower side edge 76 of the retainer or distal panel 68 is restrained against movement inwardly of the storage compartment by contact with the adjacent surface of the dome-shaped body of the sealed beam unit and this serves to maintain the integrity of the hollow triangular-shaped column when it is subjected to a compressive load which might otherwise tend to move the retainer panel inwardly of the container space.

Figure 3:
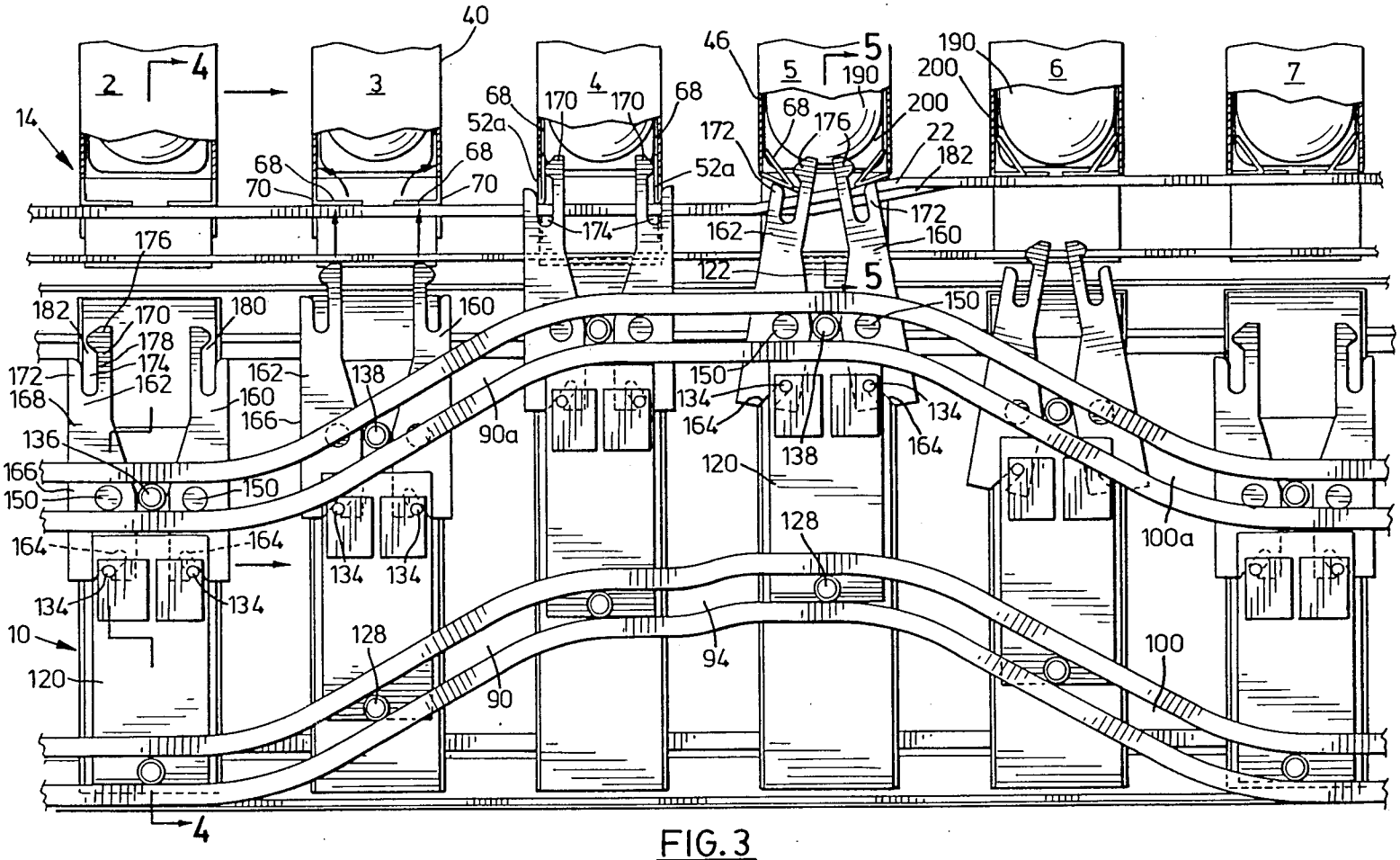

To position the retainer panel in an operable position, the bottom flap 56 is initially raised from the position shown in FIG. 3, to an extent that it will project into the space between the extension lugs **52*b* of the side flaps 52. To facilitate the positioning of the flap 56 in this slightly elevated position, the flap 56 has a sufficient length to ensure that its marginal edge portion will project outwardly from the outer edges 62 of the side flaps. After the bottom flap 56 has been slightly elevated in this manner, the side flaps 52 are then folded inwardly by engaging the outer surface of the retainer panels 68. The inward movement of the lugs 52*b* will be interrupted by contact with the side edges of the bottom flap 56. The retainer panel 68 can, however, continue to be moved inwardly and will hinge along the hinge lines 70. The retainer panel 68 can be folded inwardly until they extend in an acute angle with respect to the portions 52a of the flaps 52. The bottom wall 56 is then lowered out of the path of travel of the flaps 52 to permit the flaps 52 to be folded inwardly along the hinge line 64 until the portions 52*a* and 52*b* extend transversely of the end of the storage compartment. When the pressure which is applied to the retainer panel 68 to fold it inwardly is removed, the natural tendancy of the paperboard material to return the retainer panel 68 to the plane of the flap 52 will operate to prevent the retainer panel 68 remaining in a face-to-face relationship with respect to the portion 52*a*. Thus ensuring that the retainer panel 68** will be operably located in the carton.

The lower extensions **52*b* of the oppositely disposed side flaps are of a sufficient length to overlap and are adhesively secured to one another when in a closed position. The top and bottom flaps 54 and 56 are folded into an outwardly overlying relationship with respect to the side flaps 52 and are initially adhesively secured thereto. A reclosing tab 98 and a reclosing notch 92 are formed on the top flap 54 and in the bottom flap 56** respectively.

Figure 2:
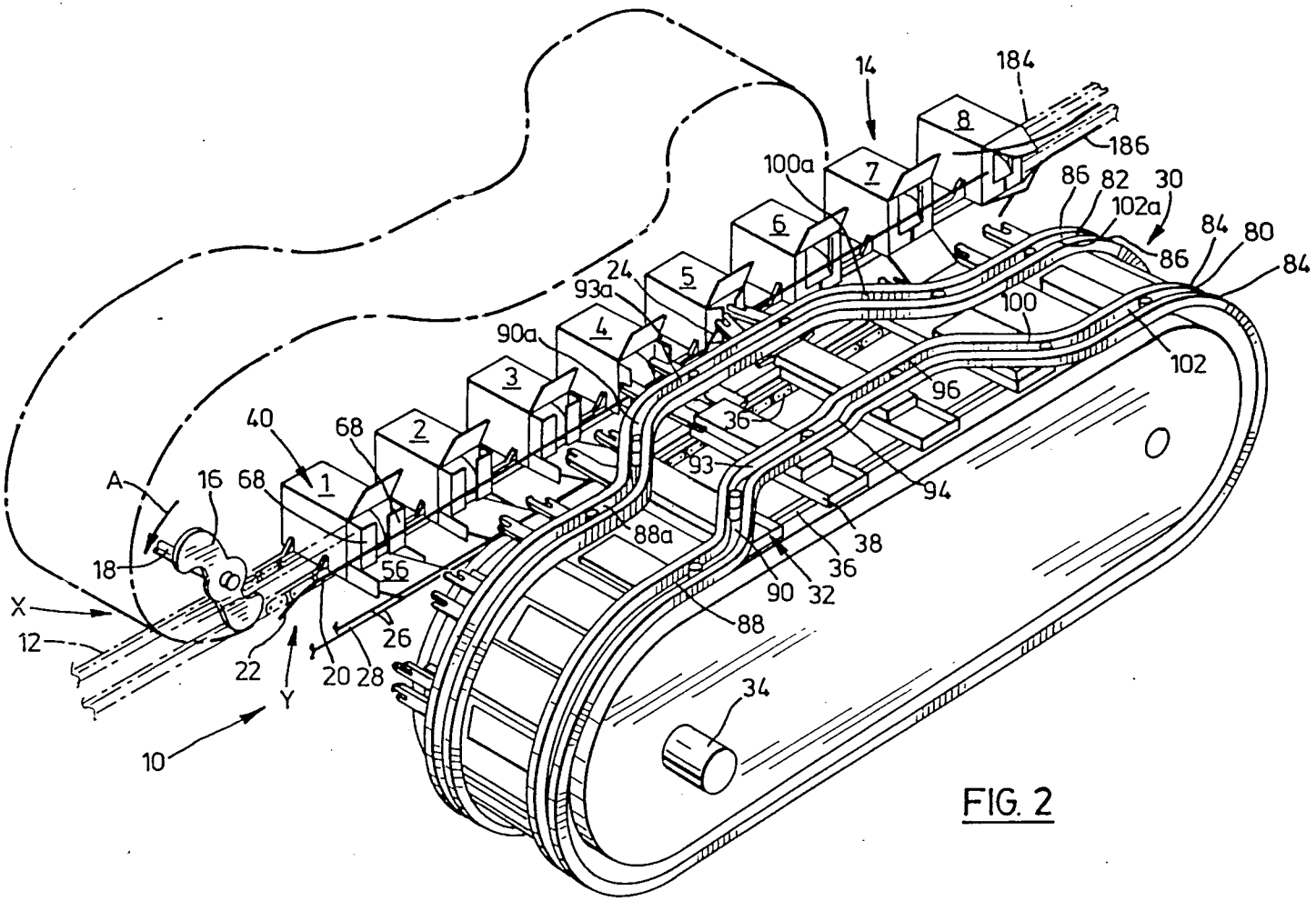

With reference to FIG. 2 of the drawings, the reference numeral 10 refers generally to a tucking and folding mechanism for closing the end of a loaded carton. The tucking and folding mechanism 10 is used in association with a carton loading machine of the type in which a load is inserted into the end of a carton and thereafter the open end of the carton is closed. The carton loading machine has a primary conveyor 12 which extends continuously through the end closure station generally identified by the reference numeral 14. A kicker blade 16 is mounted for rotation on a driven shaft 18 and is driven so that its rotation in the direction of the Arrow A is synchronized with the movement of the cartons 40 on the conveyor 12 so that it will kick the distal panel 68 which is located on the trailing sideflap to assume the position shown in FIG. 2. A plow bar 20 extends continuously through the enclosing station 14 and has a flared entrance portion 22. The plow bar 20 serves to fold the distal panels 68 of the leading side flap along its hinge line 70.

The kicker blade 16 and plow bar 22 serve to position the distal panels 68 in the position shown in the carton which is located in the location No. 1 illustrated in FIG. 2.

The plow bar 20 has a short portion of its length identified by the reference numeral 24 which is obliquely offset between the locations 4 and 5. This offset portion 24 is provided so that the plow bar will closely follow the position assumed by the side flaps as they are moved toward a closed position.

A pair of guide rails 26 also extend through a major portion of the end closure station. The guide rails 26 are arranged in a spaced parallel relationship and serve to provide a guide channel 28 therebetween which receives the outer marginal portion of the lower flap 56 and serves to control the position of the lower closure flap 56.

A pair of guide rails 104 are mounted on a support structure 106 and extend through the end closure station 14 so as to maintain the panel 54 in an open position. A plow bar 182 (Fig.5) is provided which serves to bear against the panel portions 52b to ensure that they will be moved to their fully closed position after the tucking arms are withdrawn as will be described hereinafter. Additional plow bars 184 and 186 (Fig.2) are provided for the purposes of plowing the top panel 54 and bottom panel 56 to their closed position in a conventional manner.

The tucking mechanism 10 also includes a secondary conveyor which is generally identified by the reference numeral 30. The secondary conveyor 30 includes a pair of spaced parallel chains 36 which are mounted on sprockets (not shown) to provide a forward run portion 32 which extends side-by-side with the primary conveyor. The sprockets which support the chains are driven by a suitable power source through a power input shaft 34. A plurality of guide members 38 are mounted on the chains 36 and extend transversely therebetween. The guide members 38 are in the form of channel members which have a U-shaped cross-section.

The guide members 38 are arranged on the secondary conveyor so as to be aligned with a carton arranged on the primary conveyor. First and second guide tracks 80 and 82 are formed between spaced parallel guide rails 84 and 86 respectively. The guide rails 84 and 86 extend continuously around the secondary conveyor. The first guide track 80 has a first portion of its length 88 extending from the beginning of the forward run which extends parallel to the primary conveyor. A second portion 90 is inclined toward the primary conveyor, a third portion 93 extends parallel to the primary conveyor, a fourth portion 94 forms a short jog section which is inclined toward the primary conveyor, a fifth portion 96 extends parallel to the primary conveyor, a sixth portion 100 is angularly inclined away from the primary conveyor and a seventh portion 102 extends parallel to the primary conveyor and extends back to the fourth portion 94. The second guide track 82 has a first portion 88*a*, a second portion 90*a*, a third portion 93*a*, all of which extend parallel to the corresponding portions 88, 90 and 93 of the conveyor 80. The third portion 93*a* does, however, extend continuously to the portion 100*a* which extends parallel to the portion 100. Consequently, there is no portion of the length of the guide track 82 which extends parallel to the jog section 94. The second guide track 92 also includes a portion 102*a* which extends parallel to the portion 102 of the first guide track.

Figure 4:
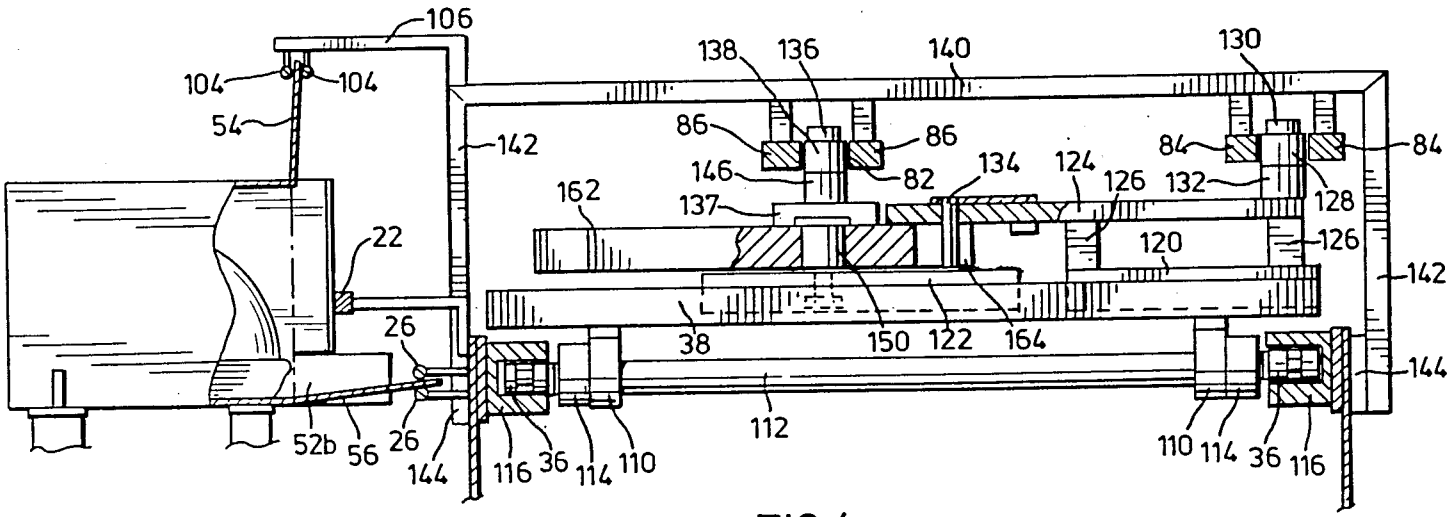

As shown in FIG. 4 of the drawings, the guide member 38 has a pair of legs 110 projecting downwardly from the underside thereof. The legs 110 are mounted on a transverse shaft 112, opposite ends of which are supported by chains 36. Collars 114 serve to retain the legs 110 in a set position with respect to the shafts 112. The chains 36 are slidably mounted in U-shaped support channels 116 which extend continuously along the forward run of the secondary conveyor.

Figure 8:
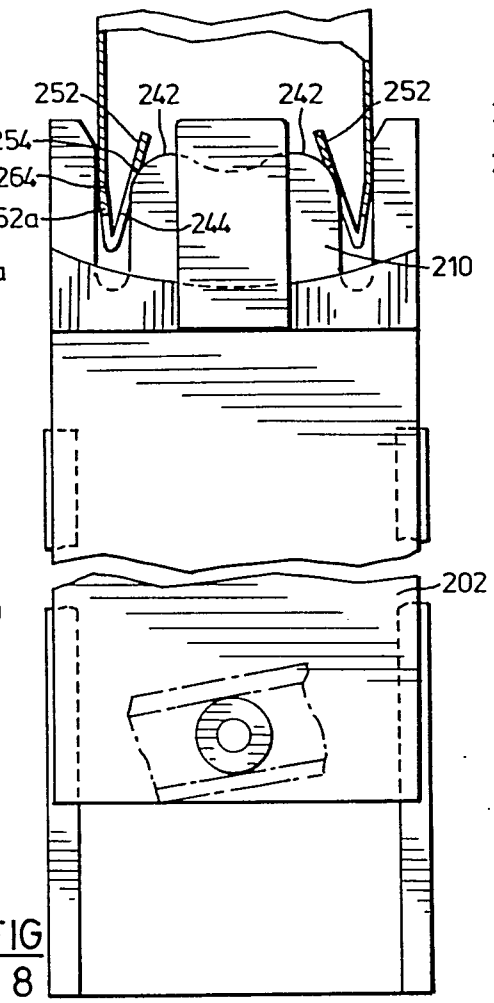

First and second slide members 120 and 122 are slidably mounted in a close-fitting sliding relationship within each guide member 38. The first slide member 120 has a top plate 124 supported thereon by support posts 126. A follower roller 128 is mounted on a support shaft 130 and is spaced from the top plate 124 by a collar 132. The follower roller 128 is located in the first guide track 80. As shown in FIG. 8 of the drawings, the first guide rails 80 are supported by an overhead beam 140 which is supported by legs 142 which extend upwardly from the main frame members 144. The top plate 124 has a pair of pins 134 extending downwardly therefrom, which as shown in FIG. 2 of the drawings, are arranged in a side-by-side spaced parallel relationship.

As shown in FIGS. 2 and 4 of the drawings, a shaft 136 is located centrall of the width of the second slide member 122 and projects upwardly from a bridge member 137 which is mounted on the second slide member 122. A second follower roller 138 is mounted on the shaft 136. The second follower roller 138 is positioned in the second guide track 82.

A pair of pivot pins 150 are also mounted on the second slide member 122 and project upwardly therefrom. Right and left tucking arms 160 and 162 are each pivotally mounted at their proximal ends 166 on a pivot pin 150. A slot 164 is formed on each of the arms 160, 162 and are arranged to be angularly inclined to converge in a direction toward the pivot pins 150. The slots 164 form guideways in which the pins 134 which are carried by the first slide member 120 will slide when the first slide member is moved relative to the second slide member.

The distal end 168 of each ducking arm is formed with a long finger 170 and a short finger 172 arranged one on either side of a notch 174. A detent 176 is formed on the inner side face of the long finger 170 to provide a recess 178. The detent 176 is spaced outwardly from the outer end of the short finger 172 such that the open ends 180 of the notches 174 have each pair of arms angularly inclined so that they diverge with respect to one another. By reason of the width of the notch and the orientation of the open ends 180, the long and short fingers can engage the enclosure flaps and cause them to move to the closed position as will be described hereinafter without damaging them in the process.

Figure 5:
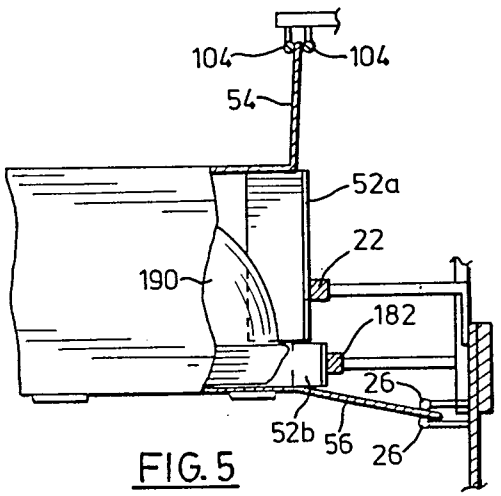
Figure 6:
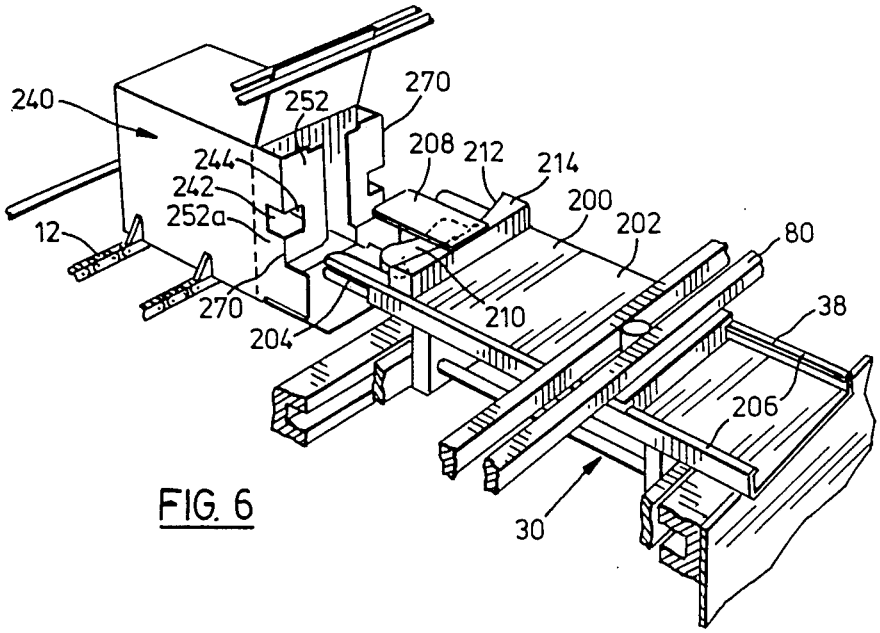
FIG. 6 is a pictorial view of a tucking device constructed in accordance with a further embodiment of the present invention.
Figure 10:
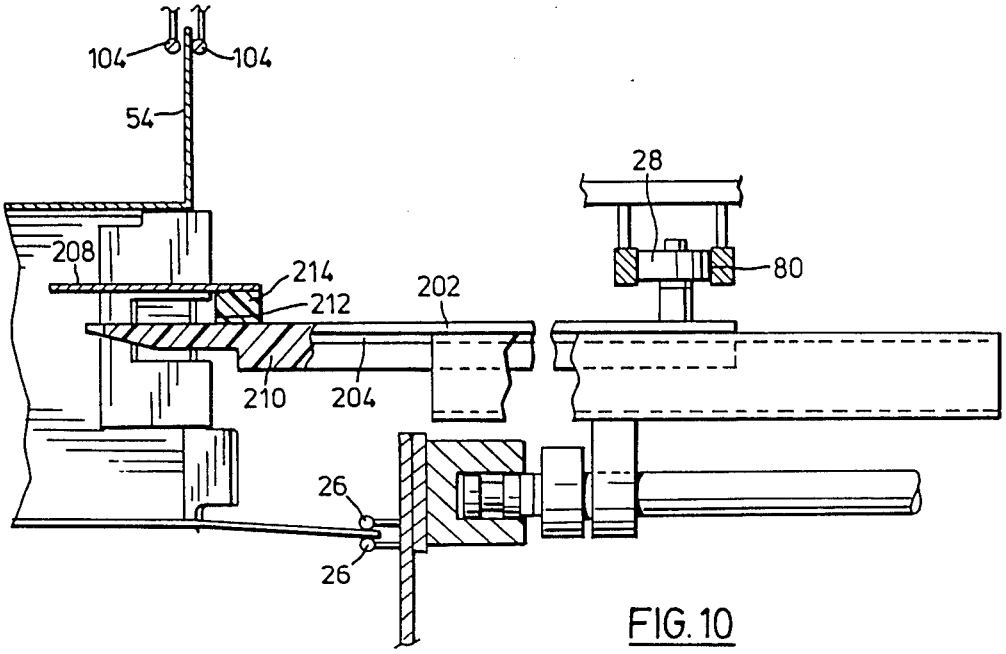
FIG. 10 is a sectional view taken along the line 10—10 of FIG. 9.

As shown in FIG. 2 of the drawings, cartons of the type illustrated in FIG. 1, having been previously positioned on the primary conveyor 12 and loaded with a sealed beam headlight 190, are driven into the end closure station 14. The outer end portion of the lower closure flap 56 is located in the guide channel 28 and the upper flap 54 is located in the guide channel formed between the guide rails 104 (FIG.5). The guide rails 26 are arranged so that the channel 28 will serve to locate the lower panel 56 in a position extending between the side panel portions **52*b* (FIG.4). as the carton enters the end closure station, the leading distal end panel 68 will be folded inwardly along its hinge line 70 as it is driven into engagement with the plow bar 20. Before the trailing distal end panel 68 engages the plow bar 20, it is folded along its hinge line 70 by means of the rotary kicker blade 16. When the trailing distal end panel 68 is folded by the kicker blade 16, it is retained in its folded position by the plow bar 20. The carton is then located in the configuration shown in position 1 illustrated in FIG. 2 of the drawings. Further continuous movement of the primary conveyor 12 advances the carton to position No. 2. When the carton is in position No. 2, its open end is aligned with the tucking fingers of the tucking and folding mechanism 10 illustrated in the extreme left hand position shown in FIG. 3. This position will also be referred to as location No. 2. As the primary and secondary conveyors are driven through the end closure station 14 toward the location No. 3, the followers 128 and 138 travel along the second sections 90 and 90*a* of the guide tracks 80 and 82 respectively such that the tucking arms 160 and 162 are advanced directly toward distal end panels 68 of their associated carton 48. This action continues until the mechanism arrives at the location No. 4. When passing from location No. 3 to location No. 4, the outer ends of the long fingers 170 will strike the panels 68 and fold them along their fold line 70 to the position shown in location No. 4 wherein they extend in a face-to-face relationship with respect to the panel portions 52*a*. The folded panels 68, 52*a* extend into the notches 174**.

As the assembly moves from location No. 4 to location No. 5, a number of events occur. The path of the guide rails 26 moves downwardly from the position shown in FIG. 4 of the drawings to the position shown in FIG. 5 of the drawings, thereby to cause the lower flap 56 to be moved downwardly from its position extending between the panels **52*b* to a position in which it no longer forms an obstacle to the closure of the panels 52*b*. In addition, the follower 128 is caused to travel along the inclined fourth portion which serves to jog the first slide member 120 toward the second slide member 122. As a result, the pins 134 are driven along the slots 164. As previously described, this causes the right and left tucking arms 160, 162 to pivot about pivot pins 150 to cause the distal ends thereof to toe in to assume the position shown in location No. 5. This action causes the short fingers 172 to engage the side wall panels 52*a* to cause the panels 52*a* and 52*b* to fold inwardly along the hinge lines 64. This action moves the detent portions 76 of the long fingers away from the distal end panels 68. The inner ends of the distal end panels 68 are driven against the side walls 46 and as a consequence, they move away from their face-to-face relationship with the panels 52*a* to assume the position in which they extend across the flanges 200 of the seal beam headlight units 190. At the same time, the plow bars 22 and 182 engage panels 52*a* and 52*b* (FIG. 5) to move them to the closed position by the time the tucking reaches location No. 6. As the tucking and folding mechanism moves from location No. 5 to location No. 6, the cam followers 138 and 128 travel along the inclined sixth portions 100. The causes the tucking arms to be withdrawn and to gradually return to the original aligned position by the time the mechanism reaches location No. 7. Thereafter, the closed cartons are advanced to location No. 8 (FIG. 2) at which time the upper and lower flaps 54 and 56 are closed by engagement with plow bars 184 and 186** respectively in a conventional manner.

An alternative tucking and folding device is illustrated in FIGS. 6 to 10 of the drawings to which reference is now made. The carton 240 is transported through the end closure station by means of a primary conveyor 12 which is the same as that previously described with reference to the previous embodiment. Similarly, the secondary conveyor 30 which conveys the tucking means 200 through the end closure station is of the same construction as that described in the previous embodiment. In this embodiment, like numerals are applied to like parts to those appearing in FIGS. 1 to 5.

The carton 240 is different from that previously described in FIG. 1 of the drawings in that clearance notches 242 and 244 are formed in the proximal panels **252*a* and distal panels 252 respectively so as to extend from the second fold line 270**.

The folding and tucking member of this embodiment is generally identified by the reference numeral 200 and comprises a slide member 202 which has guide channels 204 extending along the oppositely disposed side edges thereof which receive the flanges 206 which extend inwardly along the opposite side edges of the edge members 38. The slide member 202 has a first folding blade 208, a second folding blade 210 and a tucking cam 212 located thereon. The tucking cam 212 is formed on a cam block 214 which is mounted on and extends upwardly from the slide member 202. The tucking cam 210 has a cam surface which extends in a shallow concave arc of curvature. The first folding blade 208 is mounted on the cam block 214 and projects forwardly therefrom. The first cam blade 208 is arranged centrally of the width of the slide 202 and extends in the plane above the level of the clearance notches 242, 244 so that it will make the first contact with the distal panels 252.

Figure 9:
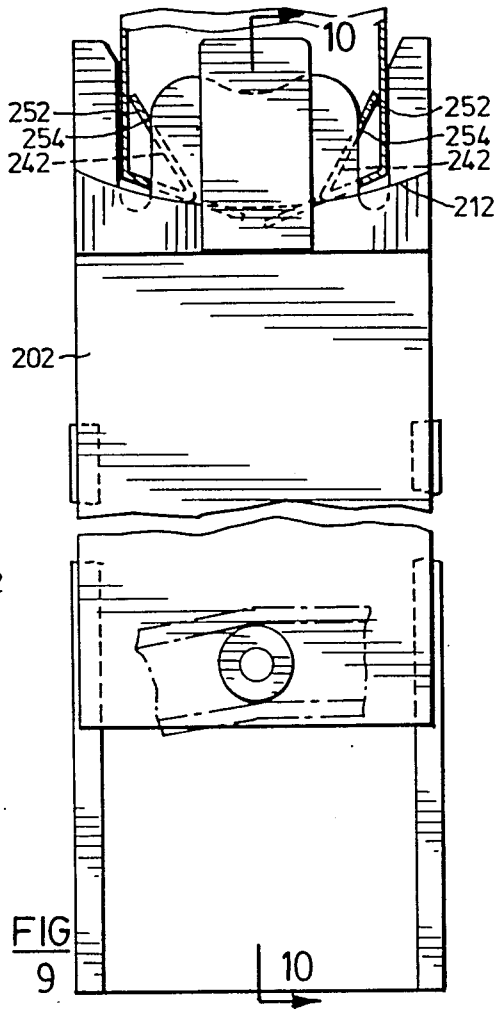
FIGS. 7, 8 and 9 are plan views of the tucking mechanism of FIG. 5 showing different stages in the movement of the tucking device.

The first folding blade 208 has a width which will permit it to extend between the oppositely disposed second hinge lines 270 of the side flaps when they are folded inwardly to the position shown in FIG. 9.

Figure 7:
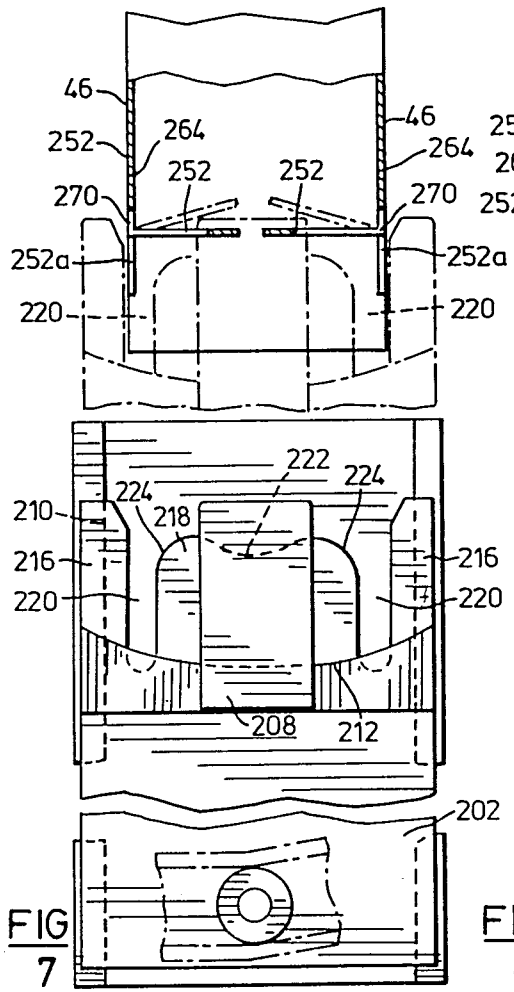

The second folding blade 210 is formed with a central tongue 218 and a pair of fingers 216 arranged on either side of the tongue 218 and spaced therefrom by notches 220. As shown in FIG. 7 of the drawing, the notches 220 are arranged to be aligned with the proximal panels **252*a* such that the fingers 216 will pass over the outer side faces of the proximal panels 252*a* and side walls 46 of the carton during the folding and tucking operation. The tongue 218 has a central portion 222 which is formed with a shallow concave curvature and rounded shoulder portions 224**.

As shown in FIG. 7 of the drawings, when the slide member 202 is moved from the position shown in solid lines to the position shown in broken lines, the outer end of the first folding blade 202 will initially make contact with the distal panels 252 to begin to fold them inwardly along the second hinge lines 270. The fingers 210 will pass over the outer side faces of the proximal panels 252*a* and will serve to prevent outward folding of these panels along the first hinge lines 264. Further movement of the slide 202 to the position shown in FIG. 8 brings the rounded shoulders 242 of the second folding blade 210 into contact with the distal panels 252. It will be noted that the contact between the shoulders 242 and the distal panel 252 is along the inner edge 254 of the notches 244. This type of contact serves to cause the proximal panel 252*a* to begin to fold inwardly along the first hinge line 264 to assume the slightly toed in configuration illustrated in FIG. 8. This slight toed in attitude of the end closure flaps serves to ensure that these flaps will fold inwardly toward one another when contact is made with the cam face 212.

With reference to FIGS. 8 and 9 of the drawings, it will be seen that when the slide 202 moves from the position shown in FIG. 8 to the position in FIG. 9, the tucking cam 212 will engage the end closure panels along the second hinge line and will fold these panels inwardly to assume the position shown in FIG. 9. It will be noted that the contact between the side edges of the tongue 210 and the edges 254 of the notches 242 will serve to retain the distal panels 252 in the tucked position illustrated in FIG. 9.

Once the side closure flaps have been folded to assume the position shown in FIG. 9 of the drawings, the plow bar 22 (FIG. 3) will serve to retain these closure flaps in the folded and tucked configuration as shown in positions 5 and 6 of FIG. 3.

The tucking and folding mechanism illustrated in FIGS. 6 to 10 of the drawings has the advantage of being a mechanism which does not require the dynamite tucking fingers of the previous embodiment and consequently is less expensive to manufacture and simpler to maintain than that described in the previous embodiment.

From the foregoing, it will be apparent that the present invention provides a tucking and folding mechanism which is capable of carrying out the complex tucking and folding operations required in order to close the carton of the type described. The mechanism is capable of operating at high speed.

It will be apparent that while the mechanism has been described in use when closing the end of the carton after it is loaded, the same mechanism can be used for closing the opposite end of the carton before it is loaded.

We claim:

1. In a carton loading machine in which loaded cartons are conveyed through an end closure station, each carton having a load storage compartment formed therein, first and second oppositely disposed side closure flaps hingedly connected to the opposite side walls of the carton along side hinges, said first and second side flaps each comprising a proximal panel which extends from its associated side hinge and a distal panel which is hingedly connected to the proximal panel along a second hinge which extends parallel to the side hinge, the proximal panel having an extension which projects beyond the second hinge line and is initially co-extensive with the distal panel, the improvement of;

(a) means for initially locating the proximal panels and their extensions so that they extend in the plane of their associated side wall and the distal panels extend transversely inwardly across the open end of the article storage compartment, (b) tucking means for tucking and folding the side closure flaps, each tucking means comprising; a set of right and left tucking arms each having a proximal end and a distal end, means pivotally mounting said right and left tucking arms in a side-by-side relationship with their distal ends directed toward the open end of a carton in use, each tucking arm having long and short fingers projecting one on either side of a notch formed at the distal end thereof, the long fingers of the tucking arms of each set being located adjacent one another, (c) means for moving the tucking arms relative to their associated carton to initially advance the tucking arms of each set toward an open end of the associated carton to cause the long finger to engage the transversely extending distal panels and to fold the distal panels into a face-to-face relationship with their associated proximal panels and thereafter to cause the tucking arms of each set to pivot, to cause the distal ends thereof to toe-in toward one another to fold the proximal panel about its side hinge line and release the distal panel to allow it to pivot away from the proximal panel along said second hinge line to be located within the carton in a position extending obliquely toward its associated side wall, and thereafter to withdraw the tucking arms and progressively return the tucking arms to their initial position.

2. A carton loading machine as claimed in claim 1, wherein the long finger of each arm has a side face extending along one side of its associated notch, said one side face having a recess formed therein which extends from a point spaced outwardly from the outer end of the short finger to a point spaced a substantial distance inwardly of the outer end of the short finger whereby the notch has a sufficient width in the area of the recess to accommodate the outer end of the proximal panel when it is folded inwardly as aforesaid.

3. A carton loading machine as claimed in claim 1, for closing cartons of the type wherein the bottom closure flap has a sufficient length to project beyond the first and second side flaps when fully extended, the further improvement of a means for engaging the portion of the bottom closure flap which projects beyond the first and second side flaps and raising it to a position in which the bottom closure flap extends between the lower extensions of the proximal panels of the side flaps while the distal panels are folded along the second hinge lines to extend inwardly as aforesaid.

4. A carton loading machine as claimed in claim 1, wherein said means for moving the tucking arms comprises;

(a) a secondary conveyor having a forward run extending through said end closure station, (b) first and second slide members slidably mounted on said second conveyor for movement toward and away from an associated carton as the secondary conveyor is driven through said end closure station, said tucking arms being pivotally mounted on said second slide member and being connected to the first slide member, (c) guide means for guiding the movement of the first slide member relative to the second slide member to cause the distal ends of the tucking arms to toe-in as aforesaid.

5. A carton loading machine as claimed in claim 4, wherein said guide means for guiding the movement of the first slide relative to the second slide comprises;

(a) a plurality of guide members mounted on and extending transversely of the forward run of the secondary conveyor for movement through said station, one of said guide members being aligned with each carton as it is directed through said end closure station, (b) said first and second slide members being slidably mounted in said guide members, (c) first and second guide tracks extending longitudinally of said secondary conveyor, (d) first and second follower means on said first and second slide members, respectively, said first and second follower means cooperating with said first and second guide tracks respectively, such that the position of the first and second slide members is determined by the path of the first and second guide tracks respectively, (e) said first and second guide tracks each having first and second inclined forces extending toward the primary conveyor which extend parallel to one another, the second guide track having a second portion of its length extending substantially parallel to the primary conveyor, the first guide track having a second portion of its length which includes a first section extending parallel to the second portion of the second guide rail, a short jog section which is inclined toward the second guide track and a third section which extends transversely parallel to the guide track, the first and second guide tracks each having third inclined portions of their length extending away from the primary conveyor.

6. In a carton loading machine having a primary conveyor for conveying loaded cartons through an end closure station, each carton having top and bottom closure flaps hingedly connected to the top and bottom walls respectively and first and second oppositely disposed side closure flaps hingedly connected to the opposite side walls of the carton along side hinges, said first and second side flaps each comprising a proximal panel which extends from its associated side hinge and a distal panel which is hingedly connected to the proximal panel along a second hinge which extends parallel to the side hinge, the proximal panel having an extension which projects beyond the second hinge line and is initially co-extensive with the distal panel, the bottom closure flap projecting beyond said lower panel, wherein the lower and proximal panels initially extend in the plane of their associated side wall and the distal panels extend transversely inwardly across the open end of the article storage compartment, the improvement of a tucking and folding mechanism for sequentially tucking the distal panels inwardly of their associated proximal panels by folding them along the second hinge lines and thereafter folding the proximal and lower panels along the side hinge lines to extend across the end of the carton comprising;

(a) a secondary conveyor having a forward run extending through said end closure station, (b) a plurality of guide members mounted on and extending transversely of the forward run of the secondary conveyor for movement therewith through said station, one of said guide members being aligned with each carton as it is directed through said end closure station, (c) first and second guide tracks extending longitudinally of said second conveyor, (d) first and second slide members mounted on each of said guide members, (e) first and second follower means on said first and second slide members respectively, said first and second follower means cooperating with said first and second guide tracks respectively such that the position of the first and second slide members is determined by the path of the first and second guide tracks respectively, (f) a set of right and left tucking arms each having a proximal end and a distal end, said right and left tucking arms being pivotally mounting on each second slide member in a side-by-side relationship with the distal ends directed toward the primary conveyor, each arm having long and short fingers projecting one on either side of a notch formed at the distal end of the arm, said notch opening toward the primary conveyor, the long fingers of the arms of each set being located adjacent one another, (g) said first and second guide tracks each having a first inclined portion extending toward the primary conveyor which extend parallel to one another, the second guide track having a second portion of its length extending substantially parallel to the primary conveyor, the first guide track having a second portion of its length which includes a first section extending parallel to the second portion of the second guide rail, a short jog section which is inclined toward the second guide track and a third section which extends substantially parallel to the second guide track, the first and second guide tracks each having third inclined portions of their length extending away from the primary conveyor, (h) means interconnecting said right and left tucking arms and said second slide member whereby the relative movement between the first and second slide member in a first direction resulting from movement of the second follower along the jog section will cause the distal ends of each set of tucking arms to pivot toward one another and relative movement in a second direction will cause the distal ends of the tucking arms to move away from another, each set of tucking arms being operable in response to movement of their followers in the first and second guide track as the secondary conveyor moves through said end closure station to be initially advanced toward an open end of a carton to cause the long finger to engage the transversely extending distal panels and to fold the distal panels and to fold the distal panels into a face-to-face relationship with their associated proximal panels as the first and second followers travel along the first portion of the guide track, thereafter as the first follower travels along the jog in the first track, the first slide member is caused to move relative to the second slide member to cause the tucking arms to pivot, to cause the distal ends thereof to toe-in toward one another to fold the proximal panel about its side hinge line and release the distal panel to allow it to pivot away from the proximal panel along said second hinge line to be located within the carton in a position extending obliquely toward its associated side wall, and thereafter to withdraw the tucking arms and progressively return the tucking arms to their initial position as the first and second followers travel along the third inclined portions of the guide track.

7. In a carton loading machine in which loaded cartons are conveyed through an end closure station on a primary conveyor, each carton having a load storage compartment formed therein, first and second oppositely disposed side closure flaps hingedly connected to the opposite side walls of the carton along side hinges, said first and second side flaps each comprising a proximal panel which extends from its associated side hinge and a distal panel which is hingedly connected to the proximal panel along a second hinge which extends parallel to the side hinge, the proximal panel having an extension which projects beyond the second hinge line and is initially co-extensive with the distal panel, said first and second side flaps each having a passageway opening therethrough which extends on opposite sides of said second hinge line so as to form a clearance notch extending from each second hinge line when the flaps are folded along said second hinge lines, the improvement of;

(a) means for initially locating the proximal panels and their extensions so that they extend in the plane of their associated side wall and the distal panels extend transversely inwardly across the open end of the article storage compartment, (b) tucking means for tucking and folding the side closure flaps, each tucking means comprising;

a first folding blade, a second folding blade and a tucking cam mounted for simultaneous movement in a first direction and a second direction away from an open end of a carton during movement through said end closure station, said first folding blade being out of alignment with said clearance notch so as to contact the distal panels to fold them along the second fold line during movement in said first direction, said first folding blade being proportioned to pass between said proximal panels when they are folded inwardly toward one another, said second folding blade having a distal end directed toward an open end of a carton in use, said distal end being formed with a pair of notches which extend inwardly thereof and are arranged to be aligned with the side walls of a carton during movement in said first direction, said second folding blade having a folding portion forming an inner wall of said notch, said folding portion being aligned with and proportioned to fit within the clearance notch of the side flaps as the side flaps are folded along the first fold line, said tucking cam having a cam face extending transversely of the path of travel of the slide member as it moves in said first direction, said tucking cam having a concave arc of curvature which is arranged to bear against the second hinge lines to tuck the distal panels rearwardly of the proximal panels, (c) means for moving the tucking means to and fro in said first and second directions during movement through end closure station.

8. A carton loading machine as claimed in claim 7, wherein said first and second folding blades and said tucking cam are each carried by a common slide so as to be simultaneously movable as aforesaid.

9. A carton loading machine as claimed in claim 7, wherein the first folding blade is arranged to make the first contact with the side closure flaps to cause the distal panels to be folded along the second fold line and the second folding blade is arranged to contact the distal panels after their initial contact with the first folding blade to further fold the distal panels along the second fold line and to engage the distal panels to initiate inward folding of the proximal panels along said first hinge lines, said cam face being arranged to contact the side flaps at the second fold line after the initial inward folding along a first fold line to fold the proximal panels inwardly along the first fold lines to a position extending across the open end of the carton.

10. A carton loading machine as claimed in claim 9, wherein the second folding blade is formed with fingers which project in said first direction and are arranged to pass over the outer surfaces of the opposed side walls of a carton in use to prevent outward deflection of the proximal and distal panels as they are folded by the folding blades in use.

11. A carton loading machine as claimed in claim 7, for closing cartons of the type wherein the bottom closure flap has a sufficient length to project beyond the first and second side flaps when fully extended, the further improvement of a means for engaging the portion of the bottom closure flap which projects beyond the first and second side flaps and raising it to a position in which the bottom closure flap extends between the lower extensions of the proximal panels of the side flaps while the distal panels are folded along the second hinge lines to extend inwardly as aforesaid.

12. A carton loading machine as claimed in claim 7, further comprising means for moving the tucking means comprises;

(a) a secondary conveyor having a forward run extending through said end closure station, (b) first slide member slidably mounted on said second conveyor for movement toward and away from an associated carton as the secondary conveyor is driven through said end closure station, said tucking means being mounted on said first slide member, (c) guide means for guiding the movement of the first slide member relative to the primary conveyor to cause the tucking means to reciprocate to and fro as aforesaid.

13. A carton loading machine as claimed in claim 7, wherein said first and second folding blades and said tucking cam are connected to and held fast with respect to one another.

* * * * *